US006006949A

United States Patent [19]

Foster et al.

[11] Patent Number: 6,006,949

[45] Date of Patent: Dec. 28, 1999

[54] MANUALLY OPERATED RECIPROCATING LIQUID PUMP WITH SEALING VENT OPENING

[75] Inventors: Donald D. Foster; John Patrick Hinson, both of St. Charles, Mo.

[73] Assignee: Continental Sprayers International, Inc., St. Peters, Mo.

[21] Appl. No.: 09/006,121

[22] Filed: Jan. 12, 1998

[51] Int. Cl.[6] ..... B67D 5/33

[52] U.S. Cl. ..... 222/153.13; 222/321.9

[58] Field of Search ..... 222/153.13, 321.2, 222/321.9, 384, 153.11, 484

[56] References Cited

U.S. PATENT DOCUMENTS

| | | | |
|---|---|---|---|
| 4,162,749 | 7/1979 | Bennett | 222/484 |
| 4,183,449 | 1/1980 | Blake | 222/321.2 |
| 4,458,832 | 7/1984 | Corsette | 222/153.13 |
| 4,589,573 | 5/1986 | Tada | 222/153.13 |
| 4,982,900 | 1/1991 | Blake . | |
| 5,181,635 | 1/1993 | Balderrama et al. | 222/484 |
| 5,335,830 | 8/1994 | Cater . | |
| 5,388,766 | 2/1995 | Buisson . | |
| 5,390,829 | 2/1995 | Saito et al. . | |
| 5,401,148 | 3/1995 | Foster et al. . | |
| 5,476,196 | 12/1995 | Saito et al. . | |
| 5,477,990 | 12/1995 | Saito et al. . | |
| 5,503,306 | 4/1996 | Knickerbocker . | |

*Primary Examiner*—Philippe Derakshani
*Attorney, Agent, or Firm*—Howell & Haferkamp, L.C.

[57] ABSTRACT

A manually operated reciprocating liquid pump of the type comprising a plunger that reciprocates vertically in a pump chamber to dispense liquid from a container to which the pump is attached includes a vent opening to vent air to the interior of the container as liquid is drawn from the container by the pump. The pump plunger locks in its vertically downward position in the pump chamber and is provided with a stopper that plugs the vent opening and prevents liquid in the container from passing through the vent opening when the plunger is in its locked position.

19 Claims, 3 Drawing Sheets

MANUALLY OPERATED RECIPROCATING LIQUID PUMP WITH SEALING VENT OPENING

BACKGROUND OF THE INVENTION (1) Field of the Invention

The present invention pertains to a manually operated reciprocating liquid pump of the type comprising a plunger that reciprocates vertically in a pump chamber to dispense liquid from a container to which the pump is attached. The pump includes a vent opening to vent air to the interior of the container as liquid is drawn from the container by the pump. The pump plunger locks in its vertically downward position in the pump chamber and is provided with a stopper that plugs the vent opening and prevents liquid in the container from passing through the vent opening when the plunger is in its locked position.

(2) Description of the Related Art

Manually operated reciprocating liquid pumps are typically comprised of a vertically oriented pump chamber having a dip tube extending from its bottom end and a closure cap at its top end employed in attaching the pump to a liquid container. A vertically reciprocating piston is received in the pump chamber and a hollow tubular plunger extends upwardly from the piston to a dispensing head at the top end of the plunger. A spring is positioned between the bottom of the pump chamber and the piston and biases the piston, plunger and dispensing head upwardly. The plunger is manually depressed downwardly and returns upwardly under the bias of the spring when operating the pump to draw liquid from the container interior into the pump chamber and then through the plunger hollow interior and the dispensing head. An example of such a manually operated reciprocating liquid pump is disclosed in the U.S. Patent of Foster et al. U.S. Pat. No. 5,401,148, which is incorporated herein by reference.

Many manually operated reciprocating liquid pumps such as that disclosed in the above-referenced patent are provided with vent openings. The vent openings communicate the exterior atmosphere of the pump with the interior of the container when the pump plunger is reciprocated between its charge and discharge positions. The vent openings allow air to pass through the openings and enter the liquid container to fill the volume in the container interior left vacant by the liquid being dispensed by the operation of the pump. Without such vent openings, as liquid is dispensed from the container a vacuum would be created in the container that would eventually overcome the vacuum created by the pump piston moving to its charge position in the pump chamber, preventing the pump from drawing further liquid into the pump chamber, or could possibly result in the collapsing of the container inwardly on itself.

As disclosed in the above-referenced patent, many vent openings are provided in a sidewall of the pump chamber above the path of travel or the stroke of the pump piston. It has been observed that, with the pump plunger pushed downwardly to its discharge position and locked when not in use, if the container and pump are positioned on their side the liquid filling the container will pass through the vent opening and enter the portion of the pump chamber above the piston. The liquid filling the pump chamber surrounds the exterior surface of the plunger. The next time the pump is prepared for use by unlocking the plunger and permitting the spring to push the plunger out of the pump chamber to the charge position of the piston, residue of the liquid surrounding the plunger above the piston often adheres to the plunger. It is often undesirable to have the liquid product adhering to the exterior surface of the extended plunger where it can come into contact with the user's clothing possibly staining the clothing, and where it gives a generally undesirable appearance to the extended pump plunger.

This problem with prior art manually reciprocated pumps could be overcome if the pump were provided with a mechanism that would close the vent opening when the pump was not in use, thereby preventing the undesirable leakage of liquid through the vent opening into the pump chamber if the pump and container were positioned on their side.

SUMMARY OF THE INVENTION

The manually operated reciprocating liquid pump of the invention is basically comprised of a pump housing containing a pump chamber, a piston received in the pump chamber for sliding reciprocating movement between charge and discharge positions of the piston in the pump chamber, a tubular plunger extending upwardly from the piston through the pump chamber and out of the pump housing, and a dispensing head at the top of the plunger. A cap closure is also provided on the pump housing for securing the pump housing on the neck of a bottle container with the pump chamber extending into the interior of the bottle container. The construction of the liquid pump is typical among many similar liquid pumps in the prior art. The sealing vent opening of the invention, although described as being employed with a particular pump construction, could be employed on various different types of reciprocating liquid pumps including those employed in trigger sprayers where the pump element reciprocates generally horizontally.

The pump chamber has a dip tube extending downwardly from the pump chamber into the liquid of the container. A check valve is positioned between the dip tube and the bottom or inlet of the pump chamber and controls the flow of liquid upwardly through the dip tube into the pump chamber preventing the reverse flow of liquid from the pump chamber down through the dip tube. A coil spring is positioned in the pump chamber between the bottom of the chamber and the piston. The spring biases the piston upwardly toward its charge position and also biases the plunger and the dispenser head upwardly. A second check valve is provided in the plunger interior bore controlling liquid flow from the pump chamber into the bore but preventing reverse flow from the bore back into the pump chamber.

A locking collar is provided on the pump housing. The locking collar is positioned on the cap closure surrounding the pump plunger. The collar and pump plunger are rotatable relative to each other between lock and unlock positions of the plunger relative to the collar. To lock the plunger it is first moved downwardly into the pump housing causing the piston to move to its discharge position in the pump housing, and then the plunger is rotated relative to the collar moving the plunger to its lock position relative to the collar. In the lock position, a locking tab on the collar engages over a rib on the exterior surface of the plunger preventing the plunger from moving back out of the pump housing under the bias of the coil spring in the pump chamber.

The vent opening of the pump housing passes through a portion of the pump chamber wall and through a portion of the locking collar. The dispensing head is provided with annular sealing stopper that surrounds the plunger and is spaced radially outwardly from the plunger. When the plunger is depressed into the pump housing, the annular sealing stopper plugs the vent opening, thereby preventing any liquid in the container from passing through the vent opening and coming into contact with the exterior surface of the plunger. The dispensing head also seals with the locking collar preventing any leakage to the exterior of the pump. When the plunger is moved to its extended position from the pump housing, the annular sealing stopper is displaced from the vent opening thereby venting the interior of the liquid container.

DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
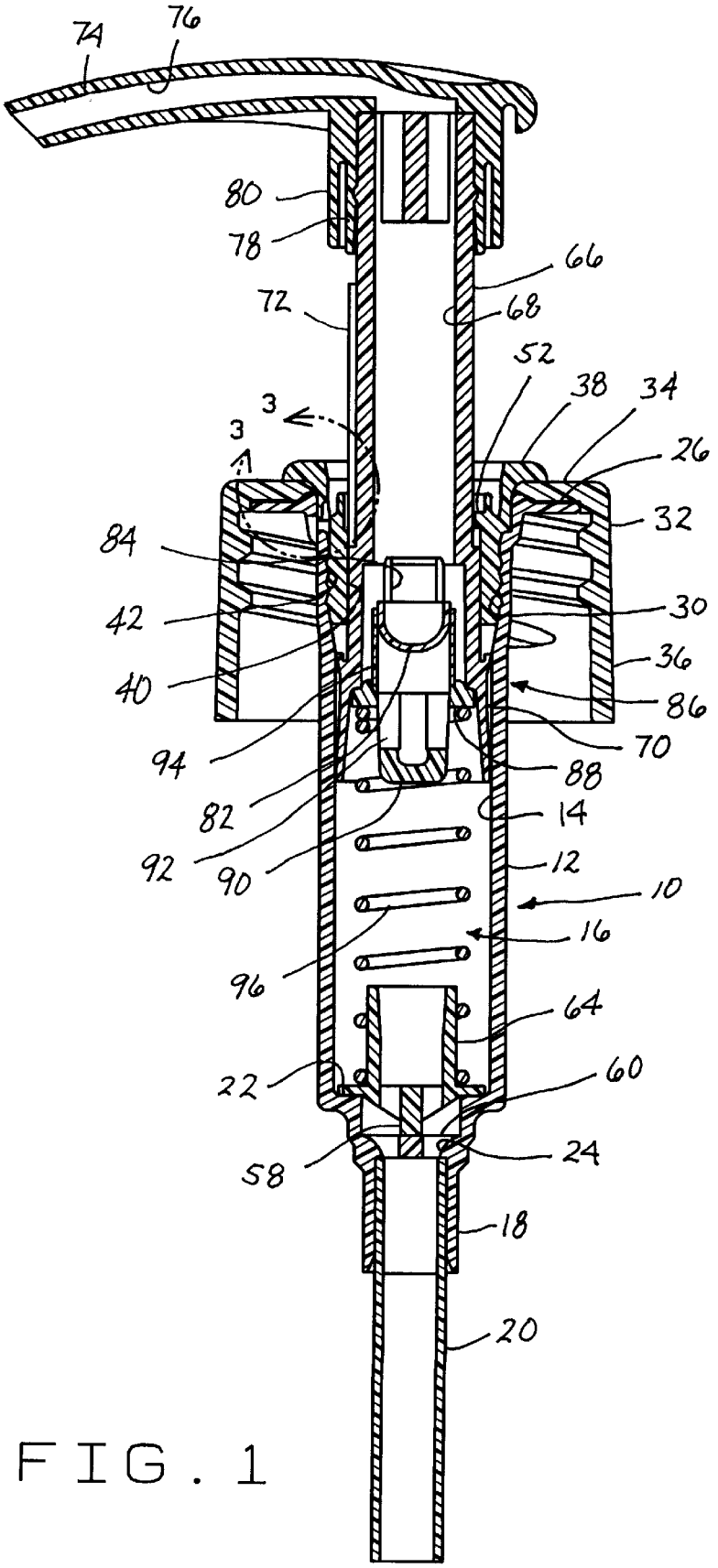
FIG. 1 is a side elevation view, in section, of the pump of the invention in its upwardly extended or charge position.

FIG. 1 shows a manually operated reciprocating liquid pump incorporating the inventive subject matter. Although the subject matter of the invention is described as being applied to a manually operated reciprocating liquid pump in which the pump plunger reciprocates vertically relative to the pump housing in usual operation, the subject matter of the invention is also equally well suited for use on other types of manually operated pumps similar to that shown in FIG. 1 as well as trigger sprayer pumps. For example, the inventive subject matter could be employed on a reciprocating liquid pump such as that disclosed in the above-referenced U.S. Patent of Foster et al. U.S. Pat. No. 5,401,148. It should be understood that the operative environment of the particular type of pump shown in the drawing figures is illustrative only and is not intended to be limiting on the subject matter of the invention.

Figure 3:
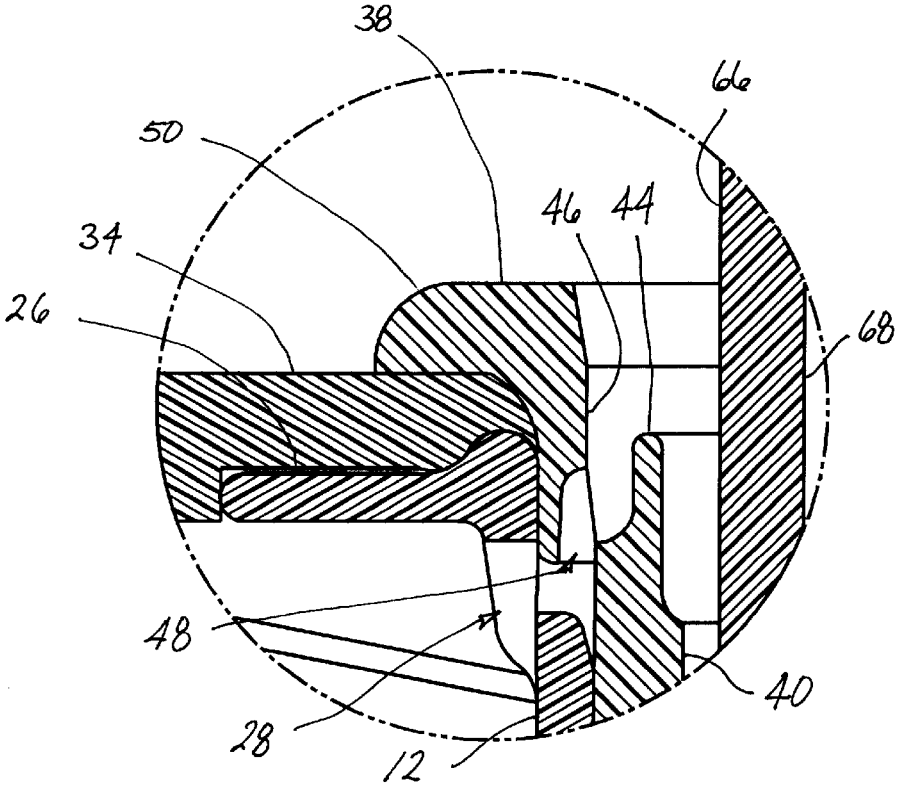
FIG. 3 is an enlarged partial view from FIG. 1 showing the detail of the vent opening of the pump.
Figure 4:
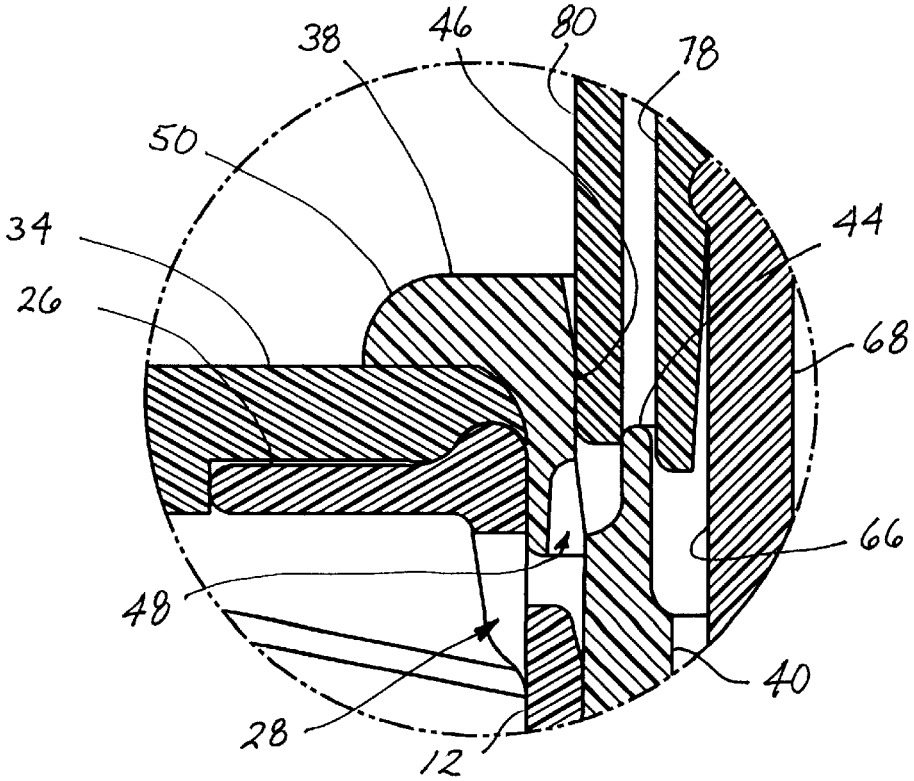
FIG. 4 is an enlarged partial view from FIG. 2 showing the vent opening of the pump closed by the annular sealing collar of the invention.

The manually operated reciprocating liquid pump 10 of the invention includes a generally cylindrical pump housing 12 having a cylindrical interior surface 14, a portion of which forms the pump chamber 16. At the bottom of the pump housing is a necked down tube 18. The necked down tube 18 receives the dip tube 20 that extends downwardly into the liquid of the liquid container (not shown) to which the pump is attached. An annular shoulder 22 is provided in the interior of the pump housing 12 at the bottom of the pump chamber 16. An annular disk valve seat 24 is also provided in the interior of the pump housing 12 just below the annular shoulder 22. The top of the pump housing has an annular flange 26 that project radially outwardly from the exterior surface of the pump housing. As best seen in FIGS. 3 and 4, an air vent opening 28 passes through the wall of the pump housing 12 just below the annular flange 26. The interior surface 14 of the pump housing just below the annular flange 26 has a series of annular ribs 30 formed therein.

A closure cap 32 is mounted for rotation on the top of the pump housing annular flange 26. The cap 32 has a circular top surface 34 with a center opening aligned with the interior of the pump housing 12. A cylindrical skirt 36 depends downwardly from the cap top surface 34 and has internal screw threading for attachment to mating screw threading on the neck of the bottle container (not shown) to which the pump is attached. Alternatively, a bayonet-type cap closure may be employed with the pump.

A locking collar 38 is press fit through the center opening of the cap closure 32 and into the interior of the pump housing 12. The locking collar has a tubular portion 40 that extends into the interior of the pump housing 12. The tubular portion 40 has external ribs 42 that mate with the internal ribs 30 of the pump housing to secure the locking collar to the pump housing. As best seen in FIGS. 3 and 4, the top of the collar tubular portion 40 is formed with an inner annular rim 44 and an outer annular rim 46. An air vent opening 48 passes through the tubular portion 40 between the inner rim 44 and outer rim 46. With the locking collar 38 secured in the pump housing 12, the air vent opening 48 of the locking collar communicates with the air vent opening 28 of the pump housing. The outer annular rim 46 passes through the center opening of the cap closure 32 and an annular flange 50 projects radially outwardly from the outer rim 46 over the cap top surface 34. The collar annular flange 50 and the pump housing annular flange 26 secure the cap closure 32 between them yet permit the cap closure to be rotated relative to the two annular flanges. A locking ring 52 is provided on the interior surface of the collar tubular portion 40. The locking ring 52 extends completely around the interior surface of the tubular portion 40 accept for a small gap left in the ring adjacent the air vent opening 48 of the locking collar.

A one-piece seal and check valve plug 54 is positioned at the bottom of the pump chamber 16. The plug has a circular base 56 that is press fit in the bottom of the pump chamber 16 and securely holds the plug in place. A center stem 58 extends downwardly from the base 56 and a flexible disk check valve 60 is provided at the bottom of the stem. The disk valve 60 covers over the circular valve seat 24 in the interior of the pump housing just above the dip tube 20. The flexibility of the disk valve 60 enables it to control the flow of liquid through the valve seat 24 and into the pump chamber 16 while preventing reverse flow from the pump chamber through the valve seat. A tubular seal 64 projects upwardly from the plug base 56. Liquid flow drawn through the seal and check valve plug 54 passes through the disk valve 60 around the stem 58 and through the center of the tubular seal 64 into the pump chamber 16.

The plunger or piston rod 66 is tubular and has a hollow interior bore 68 extending through its entire length. A cylindrical piston 70 is formed around the exterior surface of the plunger at its bottom end. The piston 70 is dimensioned to have a close sliding fit in the pump chamber 16 of the housing. The piston 70 slides between its charge position shown in FIG. 1 and its discharge position shown in FIG. 2 in the pump chamber 16 by reciprocating the plunger 66 relative to the pump housing 12, as is conventional. A ridge 72 extends axially over the exterior surface of the plunger 66 for a portion of its length. In the position of the plunger 66 relative to the pump housing 12 shown in FIG. 1, the ridge 72 is aligned with the gap in the collar locking ring 52 enabling the plunger to be reciprocated in the pump housing. However, if the plunger 66 is rotated away from its position relative to the pump housing 12 shown in FIG. 1, the ridge 72 is misaligned with the gap in the collar locking ring 52. This rotation can only take place when the plunger and pump piston are in their discharge positions shown in FIG. 2, as the locking ring 52 would prevent the plunger 66 from being rotated relative to the pump housing 12 in any other position other than the discharge position of the plunger 66 and piston 70 relative to the pump housing. When the plunger 66 and piston 70 are moved to their discharge position relative to the pump housing 21 shown in FIG. 2, rotation of the plunger 66 relative to the pump housing 12 causes the topmost end of the ridge 72 to pass beneath the collar locking ring 52, thereby locking the plunger and piston in their discharge positions relative to the pump housing. To release the plunger and piston from their locked positions relative to the pump housing, the plunger is rotated so that the ridge 72 again aligns with the gap in the collar locking ring 52 permitting the plunger and piston to move toward their charge positions relative to the pump housing. It can be seen in FIGS. 1 and 2 that the bottom end of the locking collar tubular portion 40 limits the upward movement of the piston 70 in the pump chamber 16 and thereby prevents the plunger 66 from being unintentionally removed from the pump chamber 16 when reciprocating the plunger in the pump housing.

A dispensing head 74 is fit on the top end of the plunger 66. The dispensing head 74 has an interior passageway 76 that communicates with the interior bore 68 of the plunger. The dispensing head has an inner sleeve 78 that is fit over the exterior surface of the plunger 66 at its topmost end. An annular sealing stopper 80 surrounds the inner sleeve and is spaced radially outwardly from the inner sleeve. The radial spacing of the annular sealing stopper 80 from the inner sleeve 78 is such that it will engage between the inner annular rim 44 and outer annular rim 46 of the locking collar 38 when the plunger is moved to the discharge position relative to the pump housing. This sealing engagement is shown in FIG. 4. With the plunger and piston moved to their discharge positions relative to the pump housing, the annular sealing stopper 80 nests between the inner annular rim 44 and the outer annular rim 46 of the locking collar and thereby seals closed the pump housing air vent opening 28 and the locking collar air vent opening 48. This sealing closure prevents any of the liquid contents in the container bottle to which the pump housing is attached from passing through the two air vent openings and coming into contact with the plunger exterior surface. The annular shape of the sealing stopper 80 enables it to seal closed the two air vent openings 28, 48 when the plunger is moved to its discharge position shown in FIG. 2 and is rotated relative to the pump housing to thereby lock the plunger in the discharge position relative to the pump housing. It can be seen that, with the plunger moved to the discharge position shown in FIG. 2, the annular sealing collar 80 will seal closed the air vent openings 28, 48 for all rotated positions of the plunger relative to the pump housing. Although the dispensing head 74 is preferably a lotion dispensing head, other heads may be employed without departing from the scope of the invention. For example, the lotion dispensing head 74 may be replaced by a spray head specifically designed to dispense liquid from the head in a spray pattern. The spray head would likely be preferred when the pump of the invention is employed in dispensing a less viscous fluid from the bottle container.

A valve seat 82 is formed in the interior bore 68 of the plunger adjacent its bottom end. The valve seat has a hemispherical configuration that is directed downwardly in the interior bore 68. Cross braces 84 secure the valve seat 82 in its position in the center of the plunger bore 68 providing an upward liquid flow path around the exterior of the valve seat 82 and between the cross braces 84. The hemispherical valve seat 82 and the cross braces 84 are all molded as component parts of the plunger 66.

A combination pump chamber plug and priming valve 86 is mounted in the interior bore of the plunger 68 at its bottom end. The plug/priming valve 86 has a circular ring 88 at its middle that is press fit into the plunger interior bore 68 at the bottom of the plunger to securely hold the plug/priming valve in its position in the plunger interior bore. A plug portion 90 extends downwardly from the ring. The plug portion 90 has a circular cross-section in a plane perpendicular to the center axis of the plunger interior bore 68 and is dimensioned for a tight fit in the tubular seal 64 of the seal and check valve plug 54 when the plunger is moved to its discharge position relative to the pump housing shown in FIG. 2. In this position, the plug portion 90 seals the pump chamber 16 closed preventing a flow of liquid through the dip tube 20 and the seal and check valve plug 54 into the pump chamber 16. Radial slits 92 are provided through the plug portion 90 just below the ring 88 to permit a flow of liquid around the plug portion 90, through the slits 92. A resilient tubular portion 94 projects upwardly from the ring 88 and sealingly engages around the valve seat 82. This tubular portion 94 serves as a priming valve preventing the flow of liquid from the plunger interior bore 68 back into the pump chamber 16, but allowing liquid under pressure to flex the tubular portion 94 radially away from the valve seat 82 permitting the flow of liquid from the pump chamber 16 into the plunger interior bore 68. Thereby, when the plunger is moved from its charge position toward its discharge position, the increase in liquid pressure in the pump chamber 16 causes the tubular portion 94 to flex and expand radially away from the valve seat 82 permitting the liquid in the pump chamber 16 to be pumped past the plug/priming valve 86 and into the plunger interior bore 68 and the dispensing head passageway 76.

A coil spring 96 is positioned in the pump chamber 16 between the seal and check valve plug 54 and the plug/priming valve 86. The coil spring 96 not only biases the plunger 66 and piston 70 upwardly relative to the pump housing 12, but also holds the seal and check valve plug 54 and the plug/priming valve 86 in their positions in the pump chamber 16 and plunger 66, respectively.

The liquid pumping and dispensing operation of the pump is similar to that of convention reciprocating pumps. Manually depressing the dispensing head 74 downwardly causes the plunger 66 and the piston 70 to move downwardly in the pump chamber 16 toward the bottom stroke position or the discharge position shown in FIG. 2. This downward movement increases the fluid pressure in the pump chamber due to the decreasing volume of the chamber. The increase in fluid pressure causes the resilient tubular portion 94 of the plug/priming valve 86 to flex and expand radially outwardly to open the plug/priming valve and thereby permit fluid flow, whether air when initially priming the pump or liquid from the container after the pump has been primed, to pass from the pump chamber 16 through the plug/priming valve 86 and then through the plunger interior bore 68 and the dispensing head passageway 76 to discharge liquid from the pump. Releasing the manual force on the dispensing head 74 allows the coil spring 96 to push the plunger 66 and piston 70 upwardly toward their charge position or top stroke position shown in FIG. 1. This upward movement creates a vacuum in the pump chamber 16 due to its increasing volume. The vacuum unseats the disk valve 60 and draws liquid through the dip tube 20 past the disk valve 60 and into the pump chamber. This vacuum created in the pump chamber also closes the tubular portion 94 of the plug/priming valve 86 preventing any of the liquid previously pumped into the plunger interior bore 68 from re-entering the pump chamber.

By continued reciprocating movement of the plunger and piston relative to the pump housing, the liquid is continued to be drawn from the bottle container and dispensed through the dispensing head.

Figure 2:
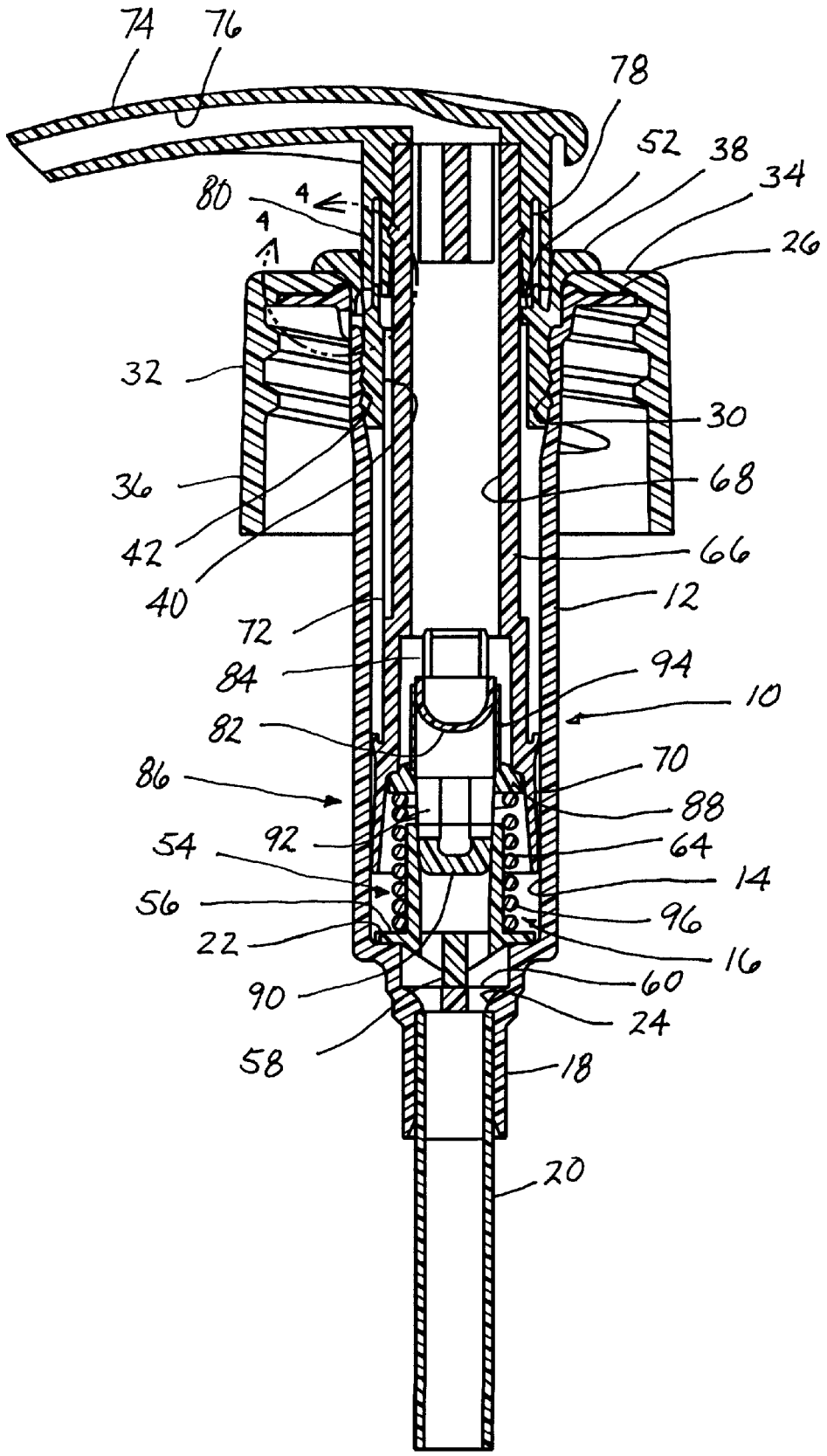
FIG. 2 is a side elevation view, in section, of the pump of FIG. 1 in its downwardly depressed, discharge position.

When the plunger 66 and piston 70 are in the bottom stroke or discharge positions relative to the pump housing 12 shown in FIG. 2, the annular sealing stopper 80 closes venting of air from the exterior of the pump to the bottle container interior through the pump housing air vent opening 28 and the locking collar air vent opening 48. When the plunger is moved to its discharge position shown in FIG. 2 and rotated relative to the pump housing to lock the plunger in position as explained earlier, the annular sealing stopper 80 closes the two air vent openings 28, 48 and prevents any liquid in the container from flowing through these openings and contacting the exterior surface of the plunger should the container and pump be positions on their side. The sealing stopper also prevents any leakage to the exterior of the pump. When the plunger 66 is moved out of its bottom stroke or discharge position shown in FIG. 2 during reciprocating operation of the pump, the annular sealing stopper 80 is displaced away from the two air vent openings 28, 48 permitting air from the exterior of the pump to pass through the air vent openings and enter the interior of the container filling the volume of the container left void by the liquid being pumped from the container interior volume. The reciprocating liquid pump of the invention thereby provides a mechanism for sealing the air vent openings closed when the plunger is in its locked position relative to the pump housing and thereby prevents unintended leakage of liquid from the bottle container through the air vent openings when the pump is not in use.

While the present invention has been described by reference to a specific embodiment, it should be understood that modifications and variations of the invention may be constructed without departing from the scope of the invention defined in the following claims.

What is claimed:

1. A manually operable reciprocating liquid pump comprising:

a pump housing containing a pump chamber;

a pump element mounted on the pump housing for reciprocating movement between charge and discharge positions of the pump element relative to the pump housing;

a vent opening in the pump housing;

a stopper mounted on the pump housing for movement of the stopper between an open position where the stopper is displaced from the vent opening and a closed position where the stopper closes the vent opening in response to the pump element moving between its charge and discharge positions, respectively;

the pump housing has a pump opening to the pump chamber that is separate from the vent opening;

the pump element is a piston mounted in the pump chamber for reciprocating movement between charge and discharge positions of the piston in the pump chamber; and a piston rod is connected to the piston and extends through the pump opening out of the pump housing.

2. The pump of claim 1, wherein:

the stopper is mounted on the piston rod and is positioned outwardly from the piston rod with a spacing between the stopper and piston rod.

3. The pump of claim 1, wherein:

the pump housing includes a collar having a lock, the pump opening passes through the collar and the piston rod is rotatable between lock and unlock positions relative to the collar, where in the lock position of the piston rod the collar lock will hold the piston in its discharge positions in the pump chamber.

4. The pump of claim 3, wherein:

the vent opening also passes through the collar.

5. The pump of claim 3, wherein:

the pump housing has a flange and the collar has a flange, and a cap is mounted for rotation between the pump housing flange and the collar flange.

6. The pump of claim 1, wherein:

the stopper is cylindrical and surrounds the piston rod with an annular spacing therebetween.

7. The pump of claim 6, wherein:

a cylindrical inner rim surrounds the pump opening and a cylindrical outer rim surrounds the inner rim with an annular spacing therebetween, and the vent opening passes through the annular spacing.

8. A manually operable reciprocating liquid pump comprising:

a pump housing containing a pump chamber;

a pump element mounted on the pump housing for reciprocating movement between charge and discharge positions of the pump element relative to the pump housing;

a vent opening in the pump housing;

a stopper mounted on the pump housing for movement of the stopper between an open position where the stopper is displaced from the vent opening and a closed position where the stopper closes the vent opening in response to the pump element moving between its charge and discharge positions, respectively;

the pump housing has a pump opening to the pump chamber that is separate from the vent opening;

the pump element is a piston mounted in the pump chamber for reciprocating movement between charge and discharge positions of the piston in the pump chamber; and a tubular pump plunger is connected to the piston for movement of the pump plunger with the piston between its charge and discharge positions, the pump plunger extends through the pump opening and out of the pump housing and has a hollow interior bore that communicates with the pump chamber, and a dispensing head is mounted on the plunger opposite its connection to the piston.

9. The pump of claim 8, wherein:

the stopper is mounted on the pump plunger and is positioned outwardly from the pump plunger with a spacing between the stopper and the pump plunger.

10. The pump of claim 8 wherein:

the pump housing includes a collar having a lock, the pump opening passes through the collar and the pump plunger is rotatable between lock and unlock positions relative to the collar, where in the lock position of the pump plunger the collar lock will hold the piston in its discharge position in the pump chamber.

11. The pump of claim 10, wherein:

the vent opening also passes through the collar.

12. The pump of claim 10, wherein:

the pump housing has a flange and the collar has a flange, and a cap is mounted for rotation between the pump housing flange and the collar flange.

13. The pump of claim 8, wherein:

the stopper is cylindrical and surrounds the pump plunger with an annular spacing therebetween.

14. The pump of claim 13, wherein:

a cylindrical inner rim surrounds the pump opening and a cylindrical outer rim surrounds the inner rim with an annular spacing therebetween, and the vent opening passes through the annular spacing.

15. A manually operable reciprocating liquid pump comprising:

a pump housing containing a pump chamber and having a pump opening to the pump chamber;

a pump element mounted to the pump chamber for movement of the pump element between charge and discharge positions of the pump element relative to the pump chamber;

a tubular pump plunger mounted on the pump element for movement of the pump plunger with the pump element between its charge and discharge positions, the pump plunger having a hollow interior bore communicating with the pump chamber;

a vent opening in the pump housing; and a stopper mounted on the pump housing for movement of the stopper between an open position where the stopper is displaced from the vent opening and a closed position where the stopper plugs the vent opening in response to the pump element moving between its charge and discharge positions, respectively.

16. The pump of claim 15, wherein:

the stopper is mounted on the pump plunger and is positioned outwardly from the pump plunger with a spacing between the stopper and the pump plunger.

17. The pump of claim 15, wherein:

the pump housing includes a collar having a lock, the pump opening passes through the collar and the pump plunger is rotatable between lock and unlock positions relative to the collar, where in the lock position of the pump plunger the collar lock will hold the piston in its discharge position in the pump chamber.

18. The pump of claim 17, wherein:

the vent opening also passes through the collar.

19. The pump of claim 15, wherein:

the cylindrical inner rim surrounds the pump opening and a cylindrical outer rim surrounds the inner rim with an annular spacing therebetween, and the vent opening passes through the annular spacing.

* * * * *